United States Patent [19]

Bense

[11] 4,006,863

[45] Feb. 8, 1977

[54] STRAND SCATTERING WINDING MACHINE

[75] Inventor: William Malcolm Bense, Barrington, R.I.

[73] Assignee: Leesona Corporation, Warwick, R.I.

[22] Filed: Oct. 6, 1975

[21] Appl. No.: 620,172

[52] U.S. Cl. ..... 242/18.1; 242/18 DD; 242/43 R

[51] Int. Cl.[2] ..... B65H 54/38

[58] Field of Search ..... 242/18.1, 18 DD, 43 R

[56] References Cited

UNITED STATES PATENTS

| | | | |
|---|---|---|---|
| 3,393,879 | 7/1968 | O'Brien | 242/18.1 |
| 3,408,014 | 10/1968 | Fisher | 242/18.1 X |

*Primary Examiner*—Richard C. Queisser
*Assistant Examiner*—Charles Gorenstein
*Attorney, Agent, or Firm*—Burnett W. Norton

[57] ABSTRACT

This application relates to an apparatus for winding strand onto a rotating member to form a package including means for traversing the strand axially of the member to form a plurality of layers thereover. A novel manner for supporting the traversing means while permitting such to oscillate so as to scatter the point at which the strand is laid down at opposite ends of the package and novel means for adjusting the stroke of such oscillation during machine operation are disclosed.

8 Claims, 8 Drawing Figures

STRAND SCATTERING WINDING MACHINE

BACKGROUND OF THE INVENTION

This invention relates to a winding machine and more particularly to a means for mounting a conventional traverse mechanism thereof so that such may be oscillated to scatter the strands being built into a package at reversal points thereof so as to prevent high ends and to the means for accomplishing such oscillation.

As used herein the term "package" is intended to mean the product of the winding machine whatever its form; the terms "strand" and "strandular material" are employed in a general sense to include all kinds of strand, either textile or otherwise and the term "scattering" means the varying of the relative axial positions of at least a portion of the strand reversals occuring across the face of the package during the winding thereof.

In the production of cross wound packages it is desirable to prevent ridges of yarn known as high ends that develop at the ends of the package since these high ends interfere with the smooth delivery of strand from such packages. High ends commonly occur and are produced by the inherent operation of traverse mechanism which tend to deposit a proportionally larger amount of strand at the end portions of a package. Many methods and operational devices for preventing the occurrance of high ends are common practice today, including the scattering of the strand cross over points by the programmed or otherwise oscillation of the traversing means. Such oscillation of traverse mechanisms can be accomplished by mechanical linkages; however, no presently satisfactory means exists for carrying out such oscillation without the necessary mechanical tolerances which cause looseness or play in linkage or tension joints so as to obtain no lost motion in the mechanisms which accomplish the required oscillation.

The principal object of the present invention is accordingly the provision of a winding device in which oscillation is transmitted to the traversing means thereof accurately and immediately by precise movements not effected by play or lost motion so as to effectively produce end scattering in a package of cross wound strand.

Another object of the present invention is to provide a winding apparatus including a means for conveniently adjusting the oscillation stroke imparted to such traversing means.

A still further object of the invention is the provision of an adjusting means for changing the oscillation imparted to the traversing means during operation of the winding machine.

These and other objects of the invention that will become apparent in the foregoing description and are accomplished by the provision of a package winding apparatus comprising a frame member, a beam, means mounted on the beam for traversing the strand axially of a package support and a pair of spaced leaf springs respectively interconnected at opposed ends thereof to the frame and the beam so as to permit transverse flexure of the beam in a parallelogram action relative to the frame when oscillating movement is applied thereto. An offset lever pivotally connected to the frame at one end and to a source of oscillation movement such as a cam and cam follower means at the other end and having an oscillator link in turn pivotably connected to the beam on which the traversing means rests provides the means by which oscillation is imparted to the package being wound so as to scatter the end reversal points thereof and accordingly prevent high ends.

Other objects and features of the invention will become more apparent by reference to the following drawings and detailed description of the invention.

DESCRIPTION OF THE PREFERRED EMBODIMENT

Figure 1:
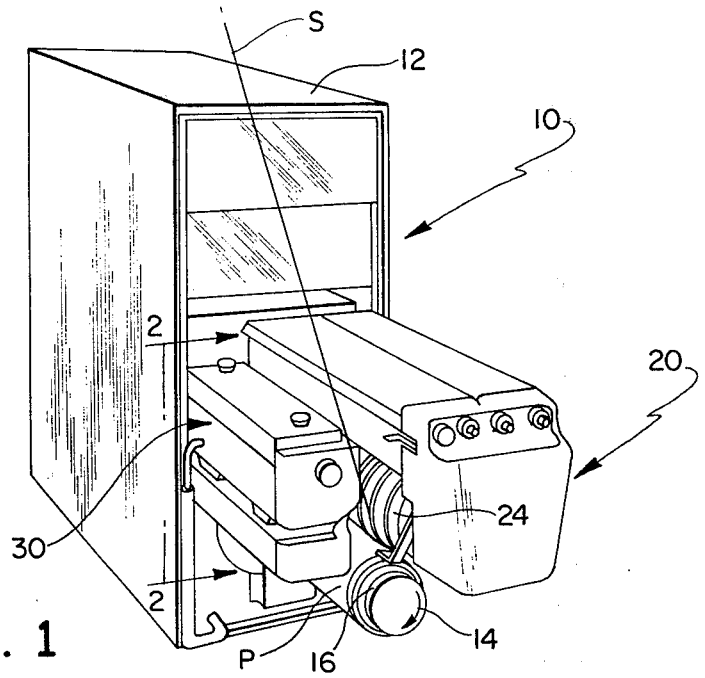
FIG. 1 is a perspective view of a winding machine incorporating the strand scattering system of the present invention.
Figure 3:
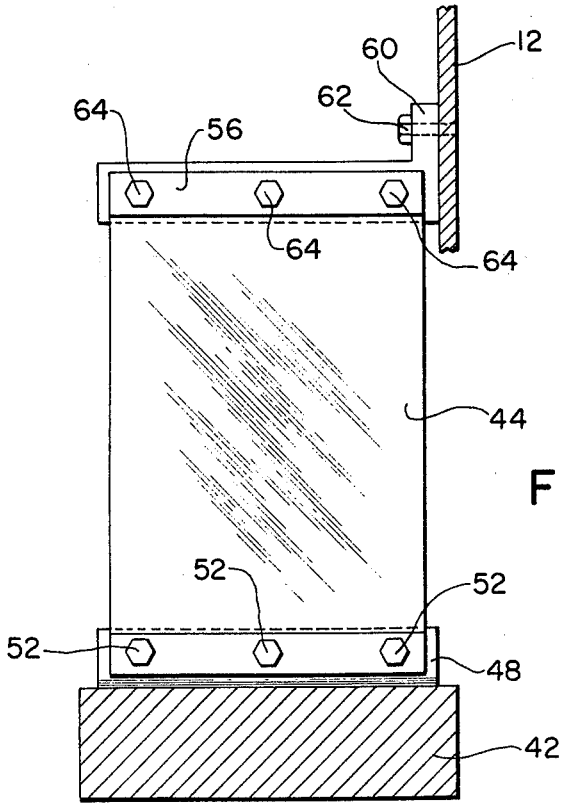
FIG. 3 is an enlarged scale side view of the portion of the machine as viewed from line 3—3 of FIG. 2.

Referring to the drawings and in particular, FIG. 1 thereof, a textile winding machine 10 commonly referred to as a takeup machine, is shown. The winding machine is adapted to wind strandular material S advancing from a source of supply such as a spinerette into a textile package P. The machine 10 includes a frame 12 on which a fixed position spindle 14 is mounted for rotation. The spindle 14 is further provided with conventional chuck means (not shown) for engaging and supporting the rotation of a package support 16 upon which the package P is built.

Drive means 20 is mounted above said spindle and includes a housing 22 which supports a rotatable drum or bail member 24 in turn driven by suitable means (not shown). The package support 16 and the spindle 14 are driven by means of the rotating drum 24 which engages the periphery of the package support 16, and ultimately with the package P of strand progressively wound thereon, to thereby rotate the same.

The machine further includes traversing means 30 having a housing 31 from which a barrel cam 32 of conventional type is mounted for rotation and which is provided with an endless helical groove 34. Traverse means 30 further includes a follower (not shown) engaged in the groove 34 of the barrel cam 32 and a traverse guide (also not shown) mounted on the outer end thereof which engages the advancing strand S. As the barrel cam is rotated by means of motor 36 through suitable power transmission means 38, the traverse guide reciprocates from reversal point to reversal point of the grooved cam and accordingly serves to distribute the strand S along the package support 16 and package P which is formed thereon.

Both the drive means 20 and the traverse means 30 and their accompanying drive means may be mounted on a counterweighted carriage which moves upwardly as the package P being wound on the support 16 progressively increases in diameter and as disclosed in my co-pending application entitled "Winding Apparatus" and filed on the same date as the subject application. Alternatively, the spindle 16 may be mounted for relative movement away from the drive means on a swingable or slidable frame support or guide in which case the drive means and traverse means would be mounted to the frame 12. It should be understood that the foregoing drive and package support means and their particular interrelation form no part of the present invention and that the term "frame" as used herein includes movable carriage means and other support mechanisms.

Figure 2:
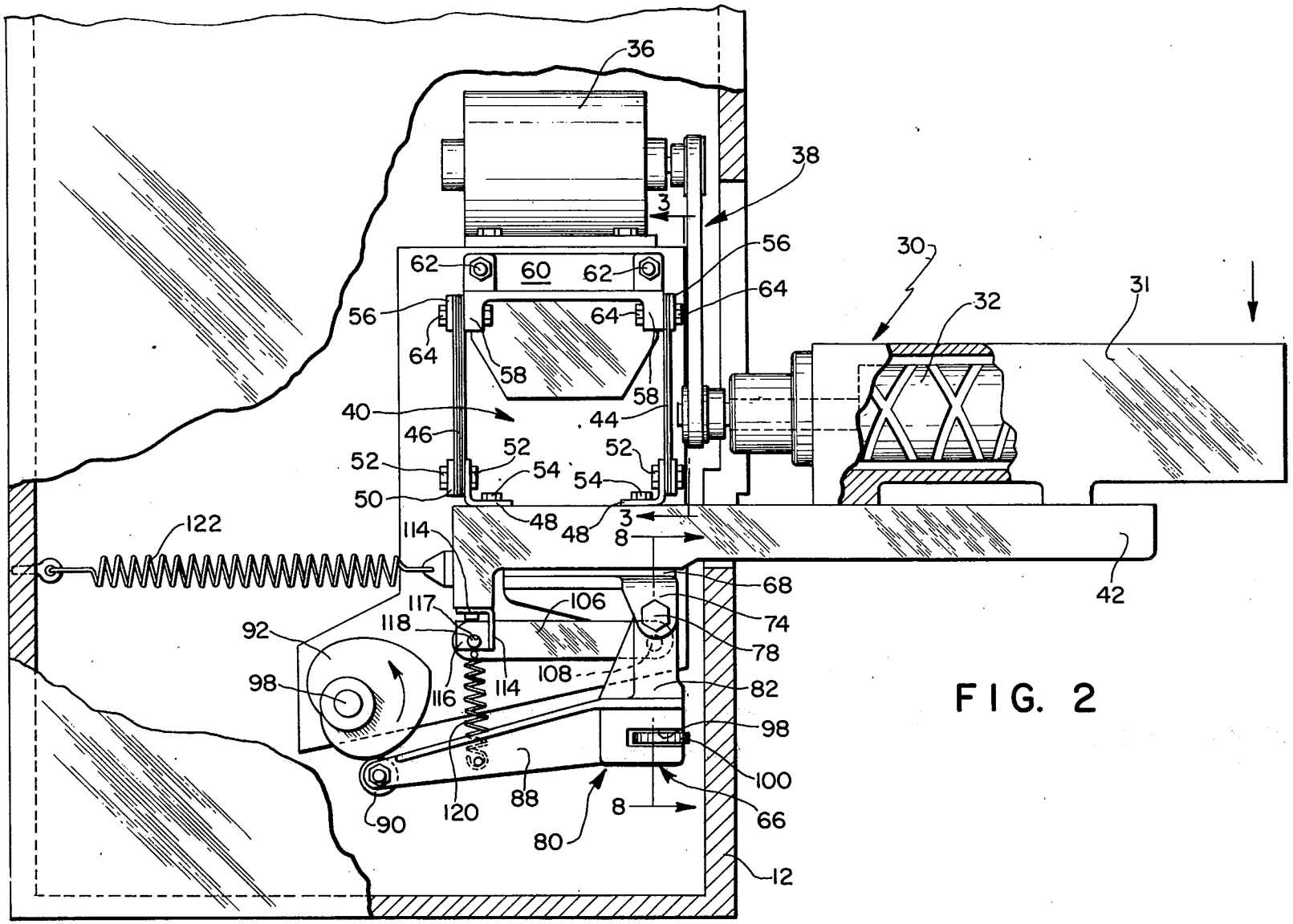
FIG. 2 is a partial side sectional view thereof taken along the line 2—2 of FIG. 1.
Figure 4:
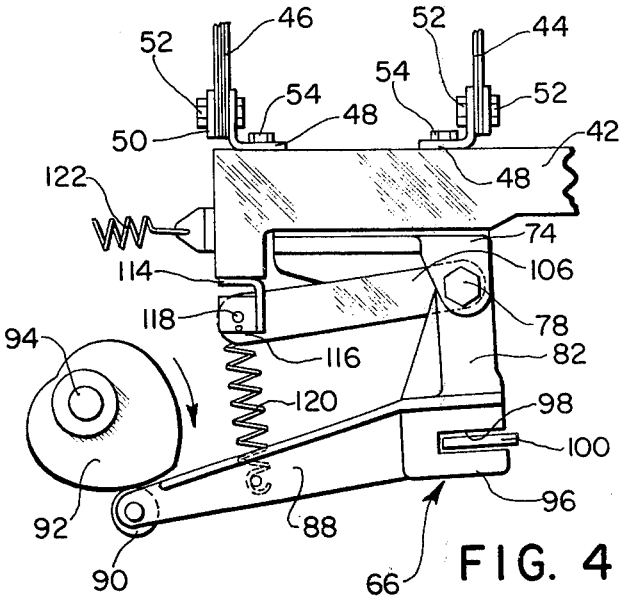
FIG. 4 is a side view of a portion of the machine shown in FIG. 2 showing a particular positioning of the oscillation system thereof.

FIG. 2 of the drawings shows the manner in which the traversing means 30 is supported from the frame 12 for oscillation movement. Such mounting means 40 includes a bed or beam member 42 of generally longitudinal configuration on which the housing 31 of the traversing means is directly connected as by welding or bolt placement, etc., at the forward end thereof (shown to the right in FIG. 2). The beam 42 is supported from the frame 12 at the rear end thereof by a pair of spaced leaf springs 44 and 46, leaf spring 44 being located proximate to the traversing means 30 while the leaf spring 46 is located distal thereto. The leaf springs may be formed of a single flat piece of spring stock or multiples thereof for reasons which will be more fully brought out hereinafter. An L-shaped bracket 48 in conjunction with a cooperating plate 50 grasp base portions of each leaf spring 44 and 46 in tight engagement by means of conventional bolt and nut means 52 and is in turn directly connected to the beam 42 by means of bolts 54. The upper ends of each leaf springs 44 and 46 are similarly engaged between a plate 56 and a U-shaped bracket 58 extending outwardly from a plate 60 in turn mounted directly to frame 12 by means of bolts 62. Bolt and nut means 64 serve to connect the upper end of each leaf spring to the bracket 58 and thus indirectly to the frame 12. It may thus be seen that the suspension means 40 enables oscillation movement to be imparted thereto by the oscillating means 66 and that such oscillation will be immediately and without looseness (such as would be caused by mechanical clearances in bearings or trunions and the like) imparted to the bed or beam 42 and in turn to the traversing means 30 by means of the side to side flexure permitted by the pair of spaced leaf springs 44 and 46. The springs 44, 46 thus essentially comprise the sole supporting or mounting connection between the traverse means 30 and the frame 12.

It should be noted in the embodiment depicted that the proximate located leaf spring 44 is made up of a double leaf spring (a single leaf could also be utilized if strong enough to withstand the tensile forces transmitted thereto) and that the leaf spring 46 is made up of a plurality of leaves generally greater than those in leaf spring 44. Accordingly such preferable construction enables compressional forces transmitted to the distal leaf spring 46 by accidental downward force applied to the traverse means 30 as indicated in the direction of the arrow in FIG. 2 and which pivots about the more proximate located spring 44 to be better absorbed by the multiple leaves of leaf spring 46. That is to say that in such circumstance, the proximate leaves are inherently adequate to withstand the resulting tensile forces while the distal leaves are increased in number to provide for the capability to withstand the columular needs to cope with the compressive force. Alternatively the traverse beam 42 could be supported by the spaced leaf springs 44 and 46 from below rather than suspended from above as depicted in the embodiment shown in the drawings. In such case accidental downward force applied to the traversing housing 31 would be transmitted as compressional force to the more proximate located spring 44 and accordingly it would be this spring that would be composed from multiple leaves rather than the more distal located spring 46 so as to be better able to withstand such compressional forces.

The oscillation system 66 is best shown by simultaneous reference to FIGS. 2, 4, 6 and 8 wherein a plate 68 having a U-shaped bracket 70 dependent therefrom serves to connect the oscillating means 66 to the frame 12 by bolts 72. The bracket 70 in turn includes a pair of spaced and downwardly extending ears 74 each in turn having a smooth bore 76 therethrough, through which a pair of spaced aligned bolts 78 threadably engage and supports an L-shaped lever 80 having an offset arm portion 82. The offset arm 82 in turn includes a bifurcated upper terminus 84 in which threaded bores 86 are provided to receive each bolt 78 and thus suspend the lever 80 for pivotal movement with respect to the frame 12 along a fulcrum comprising the center line of the aligned bolts 78.

The lever 80 further includes a cam follower arm portion 88 which in turn supports a cam follower 90. The cam follower 90 is adapted for contact with a uniform motion cam 92, it being preferable to use such uniform motion as provided by the heart shaped cam depicted so that the motion transmitted to the traversing means through the beam 42 by the oscillating means 66 produces no dwell at the stroke ends and accordingly produces a uniform axial scattering effect of the strand reversal or knuckle points rather than introducing an undesirable secondary motion wherein the package reversal points move at particular positions longer than other positions. The cam 92 may be rotated by any suitable means such as the shaft 94 shown and connected to a motor drive system (not shown).

The lever 80 is further provided at the knuckle 96 thereof with a slotted opening 98 for receipt of a threaded disc or nut 100. The nut serves to engage a threaded rod 102 positioned within the offset arm 82 of the lever 80 and provided at its upper end with a seat 104 for receipt of an oscillator link 106. The oscillator link 106 is pivotally engaged to the shaft 102 by means of a pin 108 retained by conventional means such as a retaining ring within a bore 110 in turn formed laterally through the seat 105 and an opening 112 through the end of the oscillator link 106.

The other end of the oscillator link is pivotally mounted to the beam 42 by means of a bracket 114 having a pair of spaced ears 116 each having an opening 117. A pin 118 passes through such ear openings 117 and an opening (not shown) in the end of the oscillator link 106. Accordingly the link 106 serves to transmit the cam motion from the lever 80 to the beam 42.

Figure 6:
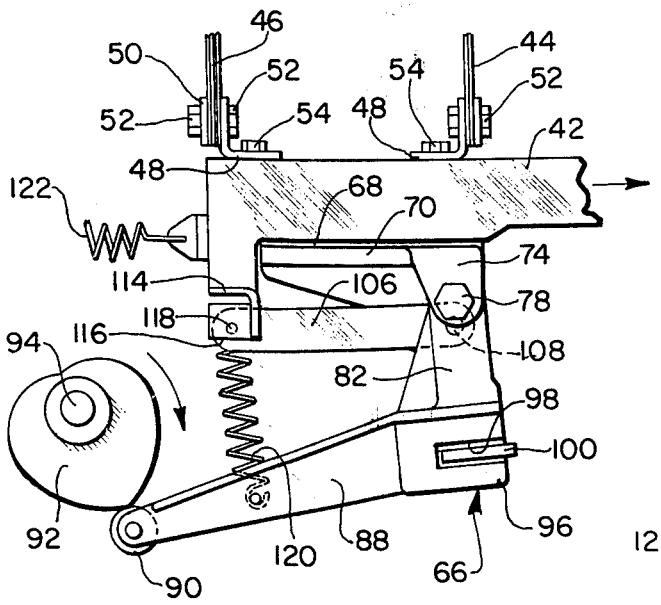
FIG. 6 is a side view of a portion of the machine similar to FIG. 4 but showing a different positioning of the oscillation system thereof.

It should be particularly noted that the oscillator link 106 is vertically adjustable within the offset arm 82 of lever 80 by means of its connection to the shaft 102 which in turn is vertically movable with respect to its retaining nut 100. It is thus apparent that the stroke of oscillation movement imparted to the lever 80 may be varied from a point wherein the full oscillation movement transmitted by the cam and cam follower is in turn imparted to the beam 42 to a point where the pivot point of the lever-oscillator link connection is in line with the fulcrum of the lever 80 connection with the bracket 70 wherein no oscillation movement will be transmitted to the beam by means of the oscillating link 106. That is, when the oscillating link 106 and rod 102 connecting pin 108 is aligned with the lever 80 fulcrum through the center line of the opposed bolts 78, then the lever 80 transmits none of its oscillation movement through the link 106 to the beam since no oscillation takes place at the fulcrum point. As the rod 102 is lowered as is shown in FIG. 6 of the drawings, a greater proportion of the oscillation movement imparted to the lever 80 is transmitted through the oscillating link 106 to the beam 42. Adjustment may also be varied while the device of the present invention is in operation since the lever 80 continues to rock with respect to its mounting bracket 70 whether or not its oscillation movement is transmitted to the beam 42 by means of the link 106 or not.

A spring 120 serves to tension the cam follower arm 88 portion of the lever 80 through a connection with the bracket 116. Furthermore a spring 122 attached to the back of the beam 42 and in turn fixed to the frame 12 serves to place a constant tension return force upon the beam 42 and provides a working force against which the oscillation system 66 operates, and accordingly prevents incidental slap motion from being imparted to the beam.

Figure 5:
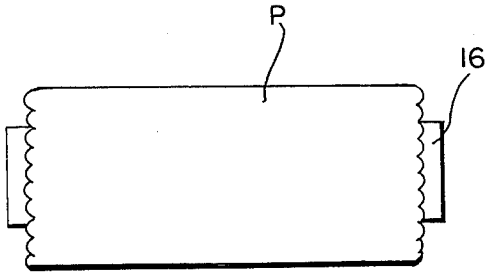
FIG. 5 is a schematic view of a strand package being wound with the oscillation system of the machine positioned as shown in FIG. 4 and showing the effect thereon.

The scattering effect of the yarn reversal or knuckle points is illustrated by reference to FIGS. 5 and 7 of the drawings which illustrate in an exaggerated schematic form the shift of the strand cross over points when oscillation movement is imparted to the beam 42 and accordingly the package support 16. Thus in FIG. 4 the oscillation link 106 is positioned at the fulcrum of the lever 80 and accordingly none of the oscillation movement imparted to the lever 80 is transmitted to the beam 42. The package formed by such positioning is illustrated in FIG. 5 of the drawings wherein the strand cross over points tend to occur at the same axial position along the package 16 and accordingly under certain conditions could lead to undesirable high ends.

Figure 7:
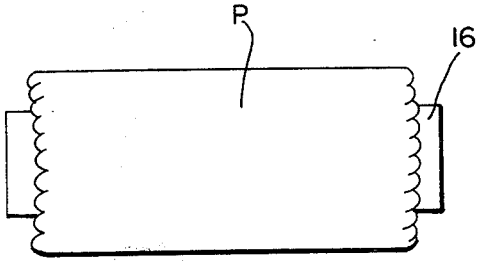
FIG. 7 is a schematic view of a strand package being wound similar to FIG. 5 with the oscillation system of the machine positioned as shown in FIG. 6 and showing the effect thereon.
Figure 8:
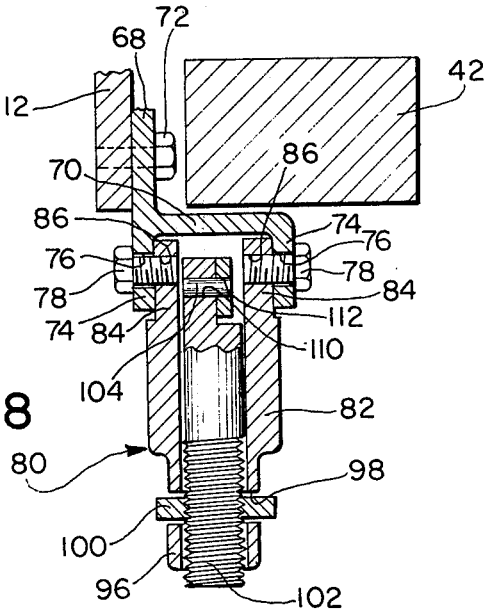
FIG. 8 is a detailed sectional view of the oscillation system of the present invention taken along the line 8—8 of FIG. 2.

On the other hand, the strand cross over points illustrated in FIG. 7 of the drawings are scattered as represented by the laterally shifted dotted line positioning thereof through the oscillation action imparted to the beam 42 when the oscillation imparting means 66 has been repositioned as shown in FIG. 6 of the drawings. Therein the oscillator link 106 has been lowered so that its pivot point connection with the lever 80 does not coincide with the fulcrum of the lever and accordingly a portion of the oscillation movement imparted to the lever 80 is in turn imparted to the beam 42 to produce the scattering effect depicted.

What is claimed is:

1. Apparatus for winding a strand onto a rotating member to form a package comprising a frame member, a beam, means mounted on said beam for traversing said strand axially of said member to form a plurality of overlying layers of said strand, a pair of spaced leaf springs respectively interconnected at opposed ends thereof to said frame and said beam to mount said beam to said frame, said mounting means permitting transverse flexure of said beam relative to said frame, and means for oscillating said beam to vary the relative axial position of the traversal strokes of said strand.

2. The apparatus of claim 1 wherein said beam is suspended from said frame by said pair of spaced leaf springs.

3. The apparatus of claim 2 wherein said traversing means is mounted at one end of said beam, said leaf spring mounting means is connected to said beam at the other end thereof, and wherein the leaf spring connection with said beam proximate to said traversing means forms a fulcrum about which downward force applied to said one end of said beam is transmitted to that leaf spring distal from said traversing means.

4. The apparatus of claim 3 wherein said distal leaf spring includes a plurality of separate leaves to distribute compression forces imparted thereto.

5. The apparatus of claim 1 wherein said oscillating means comprises a lever having an offset arm connected to said frame for pivotal movement about a fulcrum point, an oscillator link pivotably connected at one end thereof to said beam and pivotably supported at the other end thereof by the offset arm of said lever, and means for oscillating said lever.

6. The apparatus of claim 5 including means for adjusting the point along said offset arm at which said other end of said oscillator link is supported by said lever.

7. The apparatus of claim 6 wherein the range of said adjustment includes a location at said fulcrum point to locations outwardly thereof along said offset arm.

8. The apparatus of claim 5 wherein said adjusting means includes a rod threadably engaged by said offset arm at one end thereof and movable relative thereto, the other end of said rod pivotably connected to said oscillating link.

* * * * *